United States Patent [19]

Tremmel

[11] 4,411,961

[45] Oct. 25, 1983

[54] COMPOSITE ELECTROPLATED ARTICLE AND PROCESS

[75] Inventor: Robert A. Tremmel, Woodhaven, Mich.

[73] Assignee: Occidental Chemical Corporation, Warren, Mich.

[21] Appl. No.: 305,887

[22] Filed: Sep. 28, 1981

[51] Int. Cl.[3] ..... B32B 15/01; C25D 3/04; C25D 3/12; C25D 3/56

[52] U.S. Cl. ..... 428/613; 204/40; 204/41; 428/639; 428/678; 428/679; 428/680; 428/667; 428/926; 428/935

[58] Field of Search ..... 204/40, 41; 428/678–685, 926, 935, 667, 613, 639, 941

[56] References Cited

U.S. PATENT DOCUMENTS 3,090,733 5/1963 Brown ..... 428/680

3,703,448 11/1972 Clauss et al. ..... 204/40

3,994,694 11/1976 Clauss et al. ..... 428/621

*Primary Examiner*—Michael L. Lewis

*Attorney, Agent, or Firm*—Richard P. Mueller

[57] ABSTRACT

A composite electroplated article and process for making same comprising a body having a plurality of adherent electroplates of controlled thickness and composition thereon. The first layer comprises a nickel-iron alloy containing about 15 to about 50 percent by weight iron; the second layer comprises a nickel-containing plate of a sulfur content of about 0.02 to about 0.5 percent by weight; the third layer comprises a nickel-iron alloy containing about 5 to about 19 percent by weight iron but less iron than the first layer. Optionally, a decorative chromium outer layer is applied to the surface of the third layer, and preferably, an intervening nickel plate is interposed between the third layer and outer chromium layer of a type selected to induce micro-discontinuities in the outer chromium layer.

39 Claims, No Drawings

COMPOSITE ELECTROPLATED ARTICLE AND PROCESS

BACKGROUND OF THE INVENTION

The present invention broadly relates to composite electroplated articles and to a process for producing such articles provided with a composite electroplate thereover providing corrosion protection and a decorative finish to the substrate. More particularly, the present invention comprises a further improvement over a composite nickel-iron electroplated article and process as described in U.S. Pat. No. 3,994,694, granted Nov. 30, 1976. In accordance with the aforementioned United States patent, improved corrosion protection, durability and appearance are accomplished by electrodepositing on a conductive substrate, a plurality of layers of a nickel-iron alloy the inner layer of which is of a relatively high iron content while the adjacent outer layer is of a relatively lower iron content. In accordance with a preferred embodiment of the foregoing patent, a nickel-containing plate is applied on the outer nickel-iron alloy plate over which a decorative chromium plate or equivalent decorative plate is applied.

While the composite nickel-iron electroplated structure of the aforementioned U.S. patent has provided for substantially improved corrosion resistance and durability when subjected to outdoor exposure during service, such as to automotive service conditions in the form of decorative trim components, the imposition of still more stringent specifications for corrosion resistance and cosmetic defects has created a need for still further improvements in the performance of such composite nickel-iron electroplates.

In accordance with the present invention, a composite electroplated article and process for producing such article is provided which is particularly applicable for protecting basis metals such as steel, copper, brass, aluminum and zinc die castings which are subject to outdoor exposure during service, particularly to automotive service conditions. Beneficial results and corrosion protection are also achieved by the application of such composite electrodeposits on plastic substrates which have been subjected to suitable pretreatments in accordance with well-known techniques to provide an electrically conductive surface such as copper layer rendering the plastic substrate receptive to nickel electroplating. Plastics incorporating conductive fillers to render them platable can also advantageously be processed in accordance with the present invention. Typical of plastic materials which can also be electroplated are ABS, polyolefin, polyvinylchloride, and phenol-formaldehyde polymers. The provision of such a composite electroplate on plastic substrates substantially reduces or eliminates cosmetic defects such as "green" corrosion stains produced by a corrosive attack of a copper basis layer or strike on the plastic substrate.

The composite electroplated article and process of the present invention provide for still further improvements in the corrosion protection and durability of electroplated substrates while retaining the advantages of reduced cost by way of employing nickel-iron alloys as the primary electrodeposits in comparison to more costly electrodeposits of substantially pure nickel of composite nickel-electroplated articles in accordance with compositions and processes as disclosed in U.S. Pat. Nos. 3,090,733 and 3,703,448.

SUMMARY OF THE INVENTION

The benefits and advantages of the present invention are achieved by an article having an electrically conductive surface on which a composite electroplate is deposited in the form of plural layers each adherently bonded to the adjacent layer. The composite electroplate comprises a first or inner layer of a nickel-iron alloy containing an average iron content of about 15 to about 50 percent by weight; a second or intermediate nickel-containing layer of a sulfur content of about 0.02 to about 0.5 percent by weight and a third or outer nickel-iron alloy layer containing about 5 to about 19 percent by weight iron but less iron than in the first layer. Optionally, a chromium plate or flash is electrodeposited over the outer nickel-iron alloy layer. Preferably, a nickel-containing layer is electrodeposited over the third or outer nickel-iron layer of a type to induce micro-discontinuities such as micro-porosity or microcracks in the overlying outer chromium plate or flash.

In accordance with the process aspects of the present invention, the electrodeposition of a plurality of platings is performed on a body provided with an electrically conductive surface in a controlled manner to produce a composite electroplated article comprised of plural layers of a nickel-iron alloy of controlled composition separated by an intervening nickel-containing layer of controlled sulfur content, and optionally, by an outer chromium decorative layer along or in further combination with an underlying nickel-containing plate characterized to induce micro-discontinuities in the outer chromium plate.

Additional benefits and advantages of the present invention will become apparent upon a reading of the description of the preferred embodiments taken in conjunction with the specific examples provided.

DESCRIPTION OF THE PREFERRED EMBODIMENTS

In accordance with the practice of the present invention, a composite electroplated article is produced having a first or inner nickel-iron alloy plate, a second or intermediate layer of a nickel-containing plate of a controlled sulfur content and a third or outer nickel-iron alloy plate of an iron content lower than the first layer and optionally, a decorative chromium or composite nickel-chromium finish electrodeposit to provide a desired decorative appearance to the article. It will be understood that while the invention is herein described with specific reference to the use of two nickel-iron alloy plates separated by an intermediate nickel-containing electrodeposit, it will be appreciated that three or more such nickel-iron alloy layers can also be advantageously employed each separated from the adjacent nickel-iron alloy by an intervening nickel-containing layer and wherein the iron content of the adjacent layers progressively decreases from the innermost nickel-iron layer to the outermost nickel-iron layer. Ordinarily, only two nickel-iron layers are necessary to achieve the requisite corrosion protection and the use of three or more such layers is commercially undesirable for economic considerations.

The thickness of the individual layers of the composite electroplate can generally be varied in consideration of the service conditions to which the article is to be subjected in end use. The thicknesses as hereinafter described generally provide satisfactory durability and resistance to cosmetic defects over a broad range of operating conditions in further consideration of cost and processing efficiency.

The nickel-iron alloy layers comprising the first and third layer of the composite electroplated article may be deposited from electroplating baths containing nickel and iron salts of any of the compositions of the types known or commercially used in the art. Typical of such electrolytes are those described in U.S. Pat. Nos. 3,354,059; 3,795,591; 3,806,429; 3,812,566; 3,878,067; 3,974,044; 3,994,694; 4,002,543; 4,089,754 and 4,179,343 the substance of which are incorporated herein by reference. Electroplating baths of the types disclosed in the aforementioned United States patents contain nickel and iron ions in an amount to produce a nickel-iron alloy deposit of the desired composition which are introduced by way of bath soluble and compatible salts such as sulfates and halide salts. Such baths typically further contain one or a mixture of complexing agents, a buffering agent such as boric acid and/or sodium acetate, a primary or carrier brightener comprising sulfo-oxygen and/or sulfur bearing compounds in combination with secondary brighteners to achieve the requisite leveling and brightness of the alloy deposit and hydrogen ions to provide an acidic medium usually ranging in pH of about 2 up to about 5.5.

The nickel-iron alloy electrolytes are operated at a temperature usually of from about 105° F. up to about 180° F. at an average current density of about 5 to about 100 amperes per square foot (ASF) and for a period of time to electrodeposit the requisite plate thickness. The degree of agitation of the electrolyte during the electrodeposition process also influences the quantity of iron incorporated in the plate with higher magnitudes of agitation, such as air agitation producing electrodeposits of higher iron content as a rule. Particularly advantageous results are obtained employing electrolytes and process parameters as described in U.S. Pat. Nos. 3,806,429; 3,974,044 and 4,179,343 which preferably further include a reducing saccharide for maintaining the ferric ion concentration at a desired minimum level in the bath.

The electrodeposition step for depositing the first or inner nickel-iron alloy layer is performed to produce a plate having an average iron content of about 15 to 50 percent by weight and preferably from about 25 to about 35 percent by weight. The thickness of the first layer can usually range from about 0.2 to about 2 mils with thicknesses of about 0.5 to about 1 mil being preferred for most applications. The sulfur content of the first layer will typically range from about 0.01 up to about 0.1 percent by weight.

The third or outer nickel-iron layer is electrodeposited over the second intermediate layer to provide an iron content of about 5 to about 19 percent by weight and preferably from about 10 to about 14 percent by weight. In any event, the iron content of the third layer is less than that of the first layer, usually at least 2 percent less than the first layer, preferably 5 percent less than the first layer and typically about one-half the iron content of the first layer. The third layer is electrodeposited at a thickness substantially equal to the first layer, that is, about 0.2 to about 2 mils and preferably from about 0.3 to about 1 mil. The sulfur content of the third nickel-iron layer is similar to that of the first layer and preferably contains less sulfur than the intermediate second layer.

The second or intermediate layer adherently interposed between the first and third nickel-iron layers comprises a nickel-containing layer containing a controlled sulfur content of about 0.02 up to about 0.5 percent by weight, and preferably from about 0.1 to about 0.2 percent by weight. The electrodeposition of the second layer is performed to provide a plate thickness of about 0.005 to about 0.2 mil, and preferably from about 0.05 to about 0.1 mil. The deposition of the second or intermediate layer can be performed employing any of the well-known nickel electrolytes including a Watts-type nickel plating bath, a fluoroborate, a high chloride, a sulfamate nickel electrolyte and the like. While the second nickel-containing layer preferably is of substantially pure nickel containing the requisite sulfur content, it has been found that the electrolyte for depositing the second layer can become progressively contaminated during use with iron from the preceeding nickel-iron containing electrolyte, particularly if no intervening water rinse is employed, resulting in a progressive increase in the percentage of iron in the second plate. Based on tests conducted thus far, it has been found that the second layer can contain iron in the plate in amounts up to about 10 percent by weight without any significant detrimental effects on the corrosion protection and physical properties of the composite electroplate.

The controlled amount of sulfur is introduced in the second nickel-containing layer by employing anyone of a variety of sulfur compounds of the types conventionally employed in bright nickel plating baths. Appropriate sulfur compounds which are preferably used in bright nickel baths which are suitable for use include sodium allyl sulfonate, sodium styrene sulfonate, saccharin, benzene sulfonamide, naphthalene trisulfonic acid, benzene sulfonic acid and the like. Additionally, sulfur compounds which can be suitably employed or combinations thereof in the electrolyte for depositing the second layer include those described in U.S. Pat. Nos. 3,090,733; 3,795,591; and pending U.S. patent application Ser. No. 280,643 filed July 6, 1981. The teachings of the foregoing patents and pending application are incorporated herein by reference. U.S. Pat. No. 3,090,733 teaches the use of various sulfinates for imparting the requisite sulfur content to an intermediate nickel layer such as sodium benzene sulfinate, sodium toluene sulfinate, sodium naphthalene sulfinate, sodium chlorobenzene sulfinate, sodium bromobenzene sulfinate and the like. U.S. Pat. No. 3,703,448 teaches the use of thiosulfonates of nitriles or amides as a source of sulfur in the electrolyte for depositing an intermediate nickel layer. The pending U.S. application teaches the use of thiazole compounds alone or in combination with other sulfur compounds for producing an intermediate nickel deposit containing requisite sulfur content. Included among such thiazole compounds are 2-amino thiazole, 2-amino-4-methyl-thiazole, 2-amino-4,5-dimethylthiazole, 2-mercaptothiazoline, 2-amino-5-bromothiazole monohydrobromide, 2-amino-5-nitrothiazole and the like.

The particular concentration of the sulfur compound or mixture of sulfur compounds employed in the electrolyte is controlled so as to provide a sulfur content in the second layer within the ranges as hereinabove set forth. The specific concentration will vary depending the specific compound or compounds employed and are varied in accordance with conventional practice to provide the desired sulfur concentration. Typically, when a thiazole additive is employed, a concentration of about 0.01 to about 0.4 grams per liter can be employed to attain the requisite sulfur concentration.

The composite electroplate is typically applied on an electrically conductive surface having a strike of copper, brass, nickel, cobalt or a nickel-iron alloy.

The composite electroplate optionally, but preferably further includes an outer chromium plate which may be continuous or micro-discontinuous and may typically comprise a decorative plate derived from conventional trivalent or hexavalent chromium electrolytes. The outer chromium deposit may range in thickness from about 0.002 to about 0.05 mil with thicknesses of about 0.01 to about 0.02 mil being preferred. Preferably, the outer chromium plate or multiple chromium plates incorporates micro-discontinuities which can generically be defined as one having a multiplicity of microapertures. Within this generic definition, there is embraced a micro-porous plate in which the microapertures are pores generally ranging from about 60,000 to 500,000 per square inch. Additionally, the definition encompasses a microcracked plated in which microapertures are cracks ranging from about 300 to about 2,000 cracks per linear inch.

Such a micro-discontinuous chromium plate can advantageously be obtained by interposing a fourth nickel-containing layer between the third nickel-iron layer and the outer or fifth chromium plate which incorporates micro-fine inorganic particles. The microdiscontinuities in the chromium plate can also be induced by electrodeposition of a fourth nickel layer in such a state that it will be microcracked such that the subsequently deposited chromium layer will be plated in a microcracked manner as more fully described in U.S. Pat. No. 3,761,363, the substance of which is incorporated herein by reference. Alternatively, microdiscontinuities can be achieved by a fourth nickel-containing layer which is electrochemically deposited in a manner such that the fourth layer microcracks during or after the chromium deposition thereby producing a microcracked chromium layer. The foregoing procedure is more fully described in U.S. Pat. No. 3,563,864 the substance of which is incorporated herein be reference.

The improved corrosion protection and resistance against cosmetic defects of the composite electroplate of this invention has been demonstrated by tests including "Copper-Accelerated Acetic Acid-Salt Spray (Fog) Testing", hereinafter referred to as the "CASS" Test, ASTM designation: B 368-68, and the "Corrodkote" procedure, ANSI/ASTM B 380-65. In order to provide a 100 percent water break free surface, before subjecting the samples to the CASS test, the composite electroplated panels of the present invention are first subjected to an alkaline cleaning treatment to remove all surface contamination followed by cleaning with a saturated slurry containing 10 grams of magnesium oxide powder pursuant to the preparation procedure as set forth in the test description. The specification by many automotive users of chromium plated parts employed for exterior trim required passage of 22 hours of test specimens subjected to the CASS test which can be correlated to about one to two years exposure in northern urban environments. This specification has now been increased to 44 hours equivalent to about two to four years exposure in similar environments. Further increases in such specifications are expected in the future and the composite electroplated article and process of the present invention provides corrosion protection and resistance against cosmetic defects which meets the requirements of the 44 hour CASS test.

In order to further illustrate the present invention, the following examples are provided. It will be appreciated that the examples are provided for illustrative purposes and are not intended to be limiting of the scope of the present invention as herein described and as set forth in the subjoined claims.

In each of the following examples, steel test panels were electroplated with a composite electrodeposit and evaluated by the CASS test for both corrosion protection and resistance to cosmetic defects. The test panels comprise a rectangular steel panel 4 inches wide by 6 inches long which is deformed so as to provide a longitudinally extending semi-circular rib adjacent to one side edge thereof and an angularly bent section intermediate of the opposite edge so as to provide areas of low, intermediate and high current density. The intermediate current density area or checkpoint area has a plate thickness about 75 percent of the plate in the high current density (HCD) area and is 200 percent of the low current density (LCD) thickness. Each test panel is first electroplated to provide a copper strike layer of a thickness of 0.5 mil in the checkpoint area after which adherent overlying electroplates are deposited in a manner as subsequently to be described.

The composition and operating conditions of the various electrolytes used in preparing composite electroplated samples in accordance with the following examples are as follows:

| | |
|---|---|
| A. Nickel-Iron (32% Iron) | |
| $NiSO_4.6H_2O$ | 161 g/l |
| $NiCl_2.6H_2O$ | 105 g/l |
| $H_3BO_3$ | 50 g/l |
| $FeSO_4.7H_2O$ | 34.8 g/l |
| Sodium Gluconate | 19.0 g/l |
| Isoascorbic Acid | 4.7 g/l |
| Sodium Saccharin | 3.7 g/l |
| Sodium Allyl Sulfonate | 4.8 g/l |
| Secondary Brightener (a) | 0.125% by volume |
| pH | 3.2 |
| Agitation | Air |
| Cathode Current Density | 45 ASF |
| Temperature | 130° F. |
| B. Nickel-Iron (14% Iron) | |
| $NiSO_4.6H_2O$ | 155 g/l |
| $NiCl_2.6H_2O$ | 105 g/l |
| $H_3BO_3$ | 50 g/l |
| $FeSO_4.7H_2O$ | 28.5 g/l |
| Tartaric Acid | 12.8 g/l |
| Lactose Approx. | 2.5 g/l |
| Isoascorbic Acid Approx. | 3.5 g/l |
| Sodium Saccharin | 3.7 g/l |
| Sodium Allyl Sulfonate | 4.6 g/l |
| Secondary Brightener (a) | 0.250% by volume |
| Sodium Lauryl Ether Sulfate | 500 mg/l Approx. |
| pH | 3.3 |
| Agitation | None |
| Cathode Current Density | 35 ASF |
| Temperature | 135° F. |
| C. Nickel Strike with Non-Conductive Particles | |
| $NiSO_4.6H_2O$ | 312 g/l |
| $NiCl_2.6H_2O$ | 63 g/l |
| $H_3BO_3$ | 45 g/l |
| Sodium Saccharin | 2.2 g/l |
| Sodium Allyl Sulfonate | 4.0 g/l |
| Secondary Brightener (b) | 0.150% by volume |
| $SiO_2$ Solids | 4 g/l |
| Aluminum Hydroxide | 35 mg/l |
| pH | 3.7 |
| Agitation | Air |
| Cathode Current Density | 45 ASF |
| Temperature | 145° F. |
| D. Microcracked Nickel Strike | |

-continued

| | |
|---|---|
| $NiSO_4.6H_2O$ | 62 g/l |
| $NiCl_2.6H_2O$ | 165 g/l |
| $H_3BO_3$ | 35 g/l |
| Additive (c) | 0.25% by volume |
| pH | 2.3 |
| Agitation | Mild Air |
| Cathode Current Density | 30 ASF |
| Temperature | 95° F. |
| E. Hexavalent Chromium Strike | |
| Chromic Acid | 250 g/l |
| Sulfate Ion | 1.0 g/l |
| Ratio $CrO_3/SO_4^{-2}$ | 250/1 |
| Fluoride | 0.45 g/l |
| Temperature | 110° F. |
| Cathode Current Density | 150 ASF |
| F. Trivalent Chromium Strike | |
| $Cr^{+3}$ | 28.1 g/l |
| Hydroxy Acid Complexor | 28.6 g/l |
| $NH_4+$ | 48.1 g/l |
| $Cl^-$ | 50.6 g/l |
| $H_3BO_3$ | 56.0 g/l |
| Reducer | 650 mg/l |
| Specific Gravity | 1.202 |
| pH | 3.6 |
| Temperature | 70° F. |
| Cathode Current Density | 100 ASF |
| G. 0.05% S Nickel Strike | |
| $NiSO_4.6H_2O$ | 304 g/l |
| $NiCl_2.6H_2O$ | 73 g/l |
| $H_3BO_3$ | 43 g/l |
| Sodium Saccharin | 4.3 g/l |
| Sodium Allyl Sulfonate | 5.2 g/l |
| pH | 3.0 |
| Agitation | Mild Air |
| Cathode Current Density | 40 ASF |
| Temperature | 130° F. |
| H. 0.15% S Nickel Strike | |
| $NiSO_4.6H_2O$ | 304 g/l |
| $NiCl_2.6H_2O$ | 63 g/l |
| $H_3BO_3$ | 43 g/l |
| 2-Amino Thiazole | 45 mg/l |
| pH | 2.4 |
| Agitation | Air |
| Cathode Current Density | 45 ASF |
| Temperature | 145° F. |
| I. 0.15% S Nickel Strike Plus Iron to Get 6% Iron Alloy | |
| $NiSO_4.6H_2O$ | 304 g/l |
| $NiCl_2.6H_2O$ | 63 g/l |
| $H_3BO_3$ | 43 g/l |
| Tartaric Acid | 5 g/l |
| $FeSO_4.7H_2O$ | 6.4 g/l |
| 2-Amino Thiazole | 45 mg/l |
| pH | 2.4 |
| Agitation | Air |
| Cathode Current Density | 45 ASF |
| Temperature | 145° F. |

The secondary brightener (a) of electrolytes A and B above comprises a mixture of an acetylenic alcohol, a high molecular weight polyamine, and an organic sulfide. The secondary brightener (b) of electrolyte C comprises a mixture of acetylenic alcohols and acetylenic sulfonates. The additive (c) of electrolyte D is an imine additive to produce microcracking in the nickel strike.

EXAMPLE 1

A series of copper plated steel test panels as hereinabove described is electroplated in electrolyte A under the conditions as previously set forth to produce a first nickel-iron alloy layer containing about 32 percent iron which is deposited in the checkpoint area at a thickness of 0.5 mil. A second nickel-iron layer is deposited employing electrolyte B to produce an alloy deposit containing 14% iron at a thickness in the checkpoint area of 0.5 mil. The panel thereafter is electrolyzed in electrolyte C to produce a nickel strike containing finely dispersed non-conductive particles so as to induce microporosity in the overlying chromium layer. The nickel strike is deposited in a thickness of about 0.05 mil in the checkpoint area. Finally, a chromium layer is deposited on the nickel strike employing electrolyte E to a thickness of 0.01 mil in the checkpoint area.

The resultant plated panels after appropriate cleaning in a strong alkaline cleaner and magnesium oxide slurry are exposed in a CASS test cabinet for a period of 44 hours and evaluated in accordance with ASTM (B537) Specification. In accordance with this evaluation procedure, the first number represents base metal protection and the second number indicates cosmetic appearance of the test panels at the conclusion of the test. A perfect corrosion specimen showing no deterioration would rate 10/10. Progressive degrees of failure are denoted by lower numbers such that a rating below 7, for either protection or appearance is deemed unsatisfactory from a commerical standpoint for severe outdoor exposure conditions.

The average ratings for the test panels prepared in accordance with Example 1 at the conclusion of the 44 hour CASS exposure are as follows:

| | |
|---|---|
| LCD | 8/7 |
| Checkpoint | 9/8 |
| HCD | 10/10 |

EXAMPLE 2

A second series of copper plated steel test panels are electroplated in accordance with the series as described in Example 1 with the exception that a sulfur containing nickel strike layer is applied employing electrolyte G between the two nickel-iron alloy layers. The sulfur containing nickel strike layer contains 0.05 percent sulfur and is plated to a thickness of 0.05 mil in the checkpoint area.

The test panels are exposed to the CASS test procedure under the same conditions as described in Example 1 and are evaluated at the conclusion as follows:

| | |
|---|---|
| LCD | 9/9 |
| Checkpoint | 10/9 |
| HCD | 10/10 |

It is apparent that the use of the sulfur containing nickel strike in accordance with the present invention between the nickel-iron alloy layers provides for a distinct improvement over the results obtained on the test panels of Example 1 devoid of such a sulfur containing nickel strike layer.

EXAMPLE 3

The plating sequence as described in Example 2 is repeated with a third set of test panels with the exception that the sulfur containing nickel strike between the nickel-iron alloy layers is applied employing electrolyte H to provide an average sulfur content of 0.15 percent. All plate checkpoint thicknesses are substantially identical to those of Examples 1 and 2.

The test panels are again subjected to the 44 hour CASS exposure and an evaluation of the results obtained at the conclusion of the test are as follows:

| | |
|---|---|
| LCD | 10/10 |
| Checkpoint | 10/10 |
| HCD | 10/10 |

It is apparent from the results obtained on the test panels of Example 3, that an improvement in corrosion protection and resistance to cosmetic defects is obtained by an increase in the sulfur content of the intermediate nickel strike.

EXAMPLE 4

The plating sequence as described in Example 3 is repeated with a fourth series of copper plated test panels with the exception that the sulfur containing nickel strike is electrodeposited employing electrolyte I to provide an intermediate layer containing 0.15 percent sulfur and about 6 percent iron. The test panels are subjected to the CASS test and the results obtained are identical to those obtained in Example 3.

EXAMPLE 5

The plating sequence as described in Example 1 is repeated with a fifth series of copper plated test panels except that the nickel strike containing the finely dispersed non-conductive particles is eliminated so that the outer chromium layer is substantially continuous and is directly applied over the second nickel-iron plate.

The resultant composite test panels are again evaluated in the CASS exposure test and the average ratings obtained on the test panels are as follows:

| | |
|---|---|
| LCD | 6/5 |
| Checkpoint | 8/6 |
| HCD | 9/7 |

EXAMPLE 6

The electroplating sequence as described in Example 5 is repeated with a sixth series of copper plated test panels but in which a sulfur containing nickel strike of a sulfur content of 0.15 percent is plated between the high and low nickel-iron layers at a thickness of 0.1 mil in the checkpoint area employing electrolyte H. After a 44 hour CASS exposure test, the ratings on the composite electroplated test panels are as follows:

| | |
|---|---|
| LCD | 9/7 |
| Checkpoint | 10/9 |
| HCD | 10/10 |

EXAMPLE 7

The plating sequence as described in Example 3 is repeated on a seventh series of copper plated test panels with the exception that the nickel strike deposit containing finely dispersed non-conductive particles electrodeposited by electrolyte C was replaced with a microcracked nickel strike employing electrolyte D to provide an average crack density of 500 to 700 cracks per linear inch. This microcracked nickel deposit over the outer nickel-iron alloy layer induces corresponding microcracking in the overlying chromium layer.

The composite electroplated test panels are subjected to a 44 hour CASS exposure test and the average ratings obtained are as follows:

| | |
|---|---|
| LCD | 10/10 |
| Checkpoint | 10/10 |
| HCD | 10/9 |

EXAMPLE 8

The electroplating sequence of Example 6 is repeated with an eighth series of copper plated test panels with the exception that the outer decorative chromium layer is plated from a trivalent chromium electrolyte employing electrolyte F. This chromium deposit is of a micro-discontinuous nature having a pore density of 200,000 pores per square inch. The resultant composite electroplated test panels are evaluated in the 44 hour CASS exposure test and the average ratings obtained are as follows:

| | |
|---|---|
| LCD | 9/9 |
| Checkpoint | 10/9 |
| HCD | 10/9 |

The slightly lower appearance ratings of the test panels prepared in accordance with Example 8 are due to a minimal amount of visible staining which at least in part is due to the absence of the micro-discontinuous underlying nickel strike layer beneath the outer decorative chromium layer.

EXAMPLE 9

Additional copper plated test panels are processed utilizing nickel-iron electrolytes A and B of modified compositions to provide a first nickel-iron layer containing iron contents ranging from 15 to 50 percent by weight at a thickness of from 0.2 to 2 mils and a third layer of nickel-iron alloy containing iron in an amount ranging from 5 to 19 percent by weight but less than that of the first layer and at a thickness of from 0.2 to 2 mils. These test panels are also electrolyzed in electrolytes G, H and I of modified compositions to provide a second or intermediate sulfur-containing nickel strike interposed between the nickel-iron layers containing from 0.02 to 0.5 percent by weight sulfur at a thickness of 0.005 to 0.2 mil and from 0 to 10 percent iron.

Some of the composite electroplated test panels were further subjected to a decorative chromium plating step employing electrolytes E and F to provide a continuous and discontinuous chromium outer layer ranging from 0.002 to 0.05 mil in thickness. Still others of the composite electroplated test panels were further subjected to electroplating employing electrolytes C and D to provide a fourth nickel-containing layer at a thickness of 0.005 to 0.2 mil to induce micro-discontinuities in the outer chromium plate.

All of the composite electroplated test panels of this example possess satisfactory corrosion protection and resistance to cosmetic defects.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. A composite electroplated article comprising a body having an electrically conductive surface, an adherent first layer on said surface comprising a nickel-iron alloy having an average iron content of about 15 to about 50 percent by weight, an adherent second layer on said first layer comprising a nickel-containing plate having an average sulfur content of about 0.02 to about 0.5 percent by weight, and an adherent third layer on said second layer comprising a nickel-iron alloy having an average iron content less than that of said first layer and ranging from about 5 to about 19 percent by weight.

2. The article as defined in claim 1 further including an adherent chromium layer on said third layer.

3. The article as defined in claim 1 further including an adherent nickel-containing plate on said third layer and an adherent outer chromium plate.

4. The article as defined in claim 3 in which said nickel-containing layer over which said outer chromium plate is disposed induces micro-discontinuities in said chromium layer.

5. The article as defined in claim 1 in which said first layer is of a thickness of about 0.2 to about 2 mils, said second layer is of a thickness of about 0.005 to about 0.2 mil, and said third layer is of a thickness of about 0.2 to about 2 mils.

6. The article as defined in claim 1 in which the thickness of said first layer is about 0.5 to about 1 mil, the thickness of said second layer is about 0.05 to about 0.1 mil, and the thickness of said third layer is about 0.3 to about 1 mil.

7. The article as defined in claim 1 in which the average iron content of said third layer is at least 2 percent less than the average iron content of said first layer.

8. The article as defined in claim 1 in which the average iron content of said third layer is at least 5 percent less than the average iron content of said first layer.

9. The article as defined in claim 1 in which the average iron content of said third layer is about 50 percent of the average iron content of said first layer.

10. The article as defined in claim 1 in which the average iron content of said first layer is about 25 to about 35 percent by weight and the average iron content of said third layer is about 10 to about 14 percent by weight.

11. The article as defined in claim 1 in which the sulfur content of said first and said third layer ranges from about 0.01 to about 0.1 percent by weight.

12. The article as defined in claim 1 in which the sulfur content of said third layer is less than the sulfur content of said second layer.

13. The article as defined in claim 1 in which the average sulfur content of said second layer is about 0.1 to about 0.2 percent by weight.

14. The article as defined in claim 2 in which said chromium plate is of a thickness of about 0.002 to about 0.05 mil.

15. The article as defined in claim 2 in which the thickness of said chromium plate is about 0.01 to about 0.02 mil.

16. The article as defined in claim 3 in which said nickel-containing layer on said third layer is of a thickness of about 0.005 to about 0.2 mil.

17. The article as defined in claim 3 in which the thickness of said nickel-containing layer on said third layer is about 0.05 to about 0.1 mil.

18. A composite electroplated article comprising a body having an electrically conductive surface, an adherent first layer on said surface of a thickness of about 0.2 to about 2 mils comprising a nickel-iron alloy having an average iron content of about 15 to about 50 percent by weight, an adherent second layer on said first layer of a thickness of about 0.005 to about 0.2 mil comprising a nickel-containing plate having an average sulfur content of about 0.02 to about 0.5 percent by weight, and an adherent third layer on said second layer of a thickness of about 0.2 to about 2 mils comprising a nickel-iron alloy having an average iron content less than that of said first layer and ranging from about 5 to about 19 percent by weight.

19. A composite electroplated article comprising a body having an electrically conductive surface, an adherent first layer on said surface of a thickness of about 0.5 to about 1 mil comprising a nickel-iron alloy having an average iron content of about 25 to about 35 percent by weight, an adherent second layer on said first layer of a thickness of about 0.05 to about 0.1 mil comprising a nickel-containing plate having an average sulfur content of about 0.1 to about 0.2 percent by weight, and an adherent third layer on said second layer of a thickness of about 0.3 to about 1 mil comprising a nickel-iron alloy having an average iron content of about 10 to about 14 percent by weight.

20. A composite electroplated article comprising a body having an electrically conductive surface, an adherent first layer on said surface of a thickness of about 0.2 to about 2 mils comprising a nickel-iron alloy having an average iron content of about 15 to about 50 percent by weight, an adherent second layer on said first layer of a thickness of about 0.005 to about 0.2 mil comprising a nickel-containing plate having an average sulfur content of about 0.02 to about 0.5 percent by weight, an adherent third layer on said second layer of a thickness of about 0.2 to about 2 mils comprising a nickel-iron alloy having an average iron content less than that of said first layer and ranging from about 5 to about 19 percent by weight, an adherent fourth layer on said third layer comprising a nickel-containing plate of a thickness of about 0.005 to about 0.2 mil, and an adherent fifth outer chromium layer on said fourth layer of a thickness of about 0.002 to about 0.05 mil.

21. A process for making a composite electroplated article comprising the steps of providing a body with an electrically conductive surface, electrodepositing an adherent first layer on said surface comprising a nickel-iron alloy having an average iron content of about 15 to 50 percent by weight, electrodepositing an adherent second layer on said first layer comprising a nickel-containing plate having an average sulfur content of about 0.02 to about 0.5 percent by weight, and electrodepositing an adherent third layer on said second layer comprising a nickel-iron alloy having an average iron content less than that of said first layer and ranging from about 5 to about 19 percent by weight.

22. The process as defined in claim 21 including the further step of electrodepositing an adherent chromium plate on said third layer.

23. The process as defined in claim 21 including the further steps of electrodepositing an adherent fourth layer on said third layer comprising a nickel-containing plate and thereafter electrodepositing an adherent outer chromium plate on said fourth layer.

24. The process as defined in claim 23 in which said step of electrodepositing said fourth layer is performed to induce micro-discontinuities in said outer chromium plate.

25. The process as defined in claim 21 in which the steps of electrodepositing said first, second and third layers is performed to provide a first layer of a thickness of about 0.2 to about 2 mils, a second layer of a thickness of about 0.005 to about 0.2 mils and a third layer of a thickness of about 0.2 to about 2 mils.

26. The process as defined in claim 21 in which the steps of electrodepositing said first, second and third layer is performed to provide a first layer of a thickness of about 0.5 to about 1 mil, a second layer of a thickness of about 0.05 to about 0.1 mil and a third layer of a thickness of about 0.3 to about 1 mil.

27. The process as defined in claim 21 in which the steps of electrodepositing said first and third layer are performed to provide a third layer having an average iron content of at least about 2 percent less than the iron content of said first layer.

28. The process as defined in claim 21 in which the steps of electrodepositing said first and third layers are performed to provide an average iron content in said third layer at least 5 percent less than the iron content of said first layer.

29. The process as defined in claim 21 in which the steps of electrodepositing said first and third layer is performed to provide an average iron content in said third layer of about 50 percent less than the average iron content of said first layer.

30. The process as defined in claim 21 in which the steps of electrodepositing said first and third layer are performed to provide an average iron content in said first layer of about 25 to about 35 percent and an average iron content in said third layer of about 10 to about 14 percent by weight.

31. The process as defined in claim 21 in which the steps of electrodepositing said first and third layer are performed to provide an average sulfur content in said first and third layer of about 0.01 to about 0.1 percent by weight.

32. The process as defined in claim 21 in which the step of electrodepositing said third layer is performed to provide an average sulfur content in said third layer less than the average sulfur content in said second layer.

33. The process as defined in claim 21 in which the step of electrodepositing said second layer is performed to provide an average sulfur content in said second layer of about 0.1 to about 0.2 percent by weight.

34. The method as defined in claim 22 in which the step of electrodepositing said outer chromium plate is performed to provide a thickness of about 0.002 to about 0.05 mil.

35. The process as defined in claim 21 in which the step of electrodepositing said outer chromium plate is performed to provide a thickness of about 0.01 to about 0.02 mil.

36. The process as defined in claim 23 in which the step of electrodepositing said fourth layer is controlled to provide a thickness of about 0.005 to about 0.2 mil.

37. The process as defined in claim 23 in which the step of electrodepositing said fourth layer is performed to provide a thickness of about 0.05 to about 0.1 mil.

38. The process as defined in claim 22 in which the step of electrodepositing said outer chromium plate is performed to produce micro-discontinuities in said chrome plate.

39. A process for making a composite electroplated article comprising the steps of providing a body with an electrically conductive surface, electrodepositing an adherent first layer on said surface comprising a nickel-iron alloy having an average iron content of about 15 to about 50 percent by weight, electrodepositing an adherent second layer on said first layer comprising a nickel-containing plate having an average sulfur content of about 0.02 to about 0.5 percent by weight, electrodepositing an adherent third layer on said second layer comprising a nickel-iron alloy having an average iron content less than that of said first layer and ranging from about 5 to about 19 percent by weight, electrodepositing an adherent fourth layer on said third layer comprising a nickel-containing plate of a thickness of about 0.005 to about 0.2 mil in a manner to induce microdiscontinuities in an outer chromium plate, and electrodepositing an outer chromium plate on said fourth layer of a thickness of about 0.002 to about 0.05 mil.

* * * * *